US009879916B2

(12) United States Patent
Trummer et al.

(10) Patent No.: US 9,879,916 B2
(45) Date of Patent: Jan. 30, 2018

(54) GAS PURGING ELEMENT AND ASSOCIATED GAS CONNECTION ELEMENT

(71) Applicant: Refractory Intellectual Property GmbH & Co. KG, Vienna (AT)

(72) Inventors: Bernd Trummer, Graz (AT); Michael Klikovich, Hinterbruhl (AT); Roman Kulp, Vienna (AT); Leopold Kneis, Grimmenstein (AT)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 12 days.

(21) Appl. No.: 15/037,717

(22) PCT Filed: Nov. 11, 2014

(86) PCT No.: PCT/EP2014/074261
§ 371 (c)(1),
(2) Date: May 19, 2016

(87) PCT Pub. No.: WO2015/104079
PCT Pub. Date: Jul. 16, 2015

(65) Prior Publication Data

US 2016/0290722 A1 Oct. 6, 2016

(30) Foreign Application Priority Data

Jan. 9, 2014 (EP) ..... 14150656

(51) Int. Cl.
*B22D 41/08* (2006.01)
*F27D 17/00* (2006.01)
(Continued)

(52) U.S. Cl.
CPC ..... *F27D 17/002* (2013.01); *B22D 1/005* (2013.01); *C21C 5/34* (2013.01); *C21C 5/48* (2013.01)

(58) Field of Classification Search
CPC ..... B22D 1/005
(Continued)

(56) References Cited

U.S. PATENT DOCUMENTS 4,701,215 A 10/1987 Bates et al.
4,971,295 A * 11/1990 Rothfuss ..... B22D 1/005 266/220
4,978,108 A * 12/1990 Rothfuss ..... C21C 5/48 266/220

FOREIGN PATENT DOCUMENTS

CH 662963 A5 11/1987
DE 4029024 A1 3/1992
(Continued)

*Primary Examiner* — Scott Kastler
(74) *Attorney, Agent, or Firm* — Medley, Behrens & Lewis, LLC

(57) ABSTRACT

Gas purging element (10) for metallurgical applications, comprising the following features in its mounted state: a ceramic refractory body (10, 30) with a lower end and an upper end, the upper end features an upper front surface, the lower end features a lower front surface (12), a depression (20) extends from the lower front surface (12) into the lower end of the ceramic refractory body (10), the depression (20) comprises a first part (16, 16', 16") of a detachable, form-fit connection to a gas connection element (50), a fluidic connection for a treating gas through at least one gas permeable section (30) of the ceramic refractory body (10) is provided between the depression (20) and the upper front surface.

11 Claims, 3 Drawing Sheets

Figure 1:
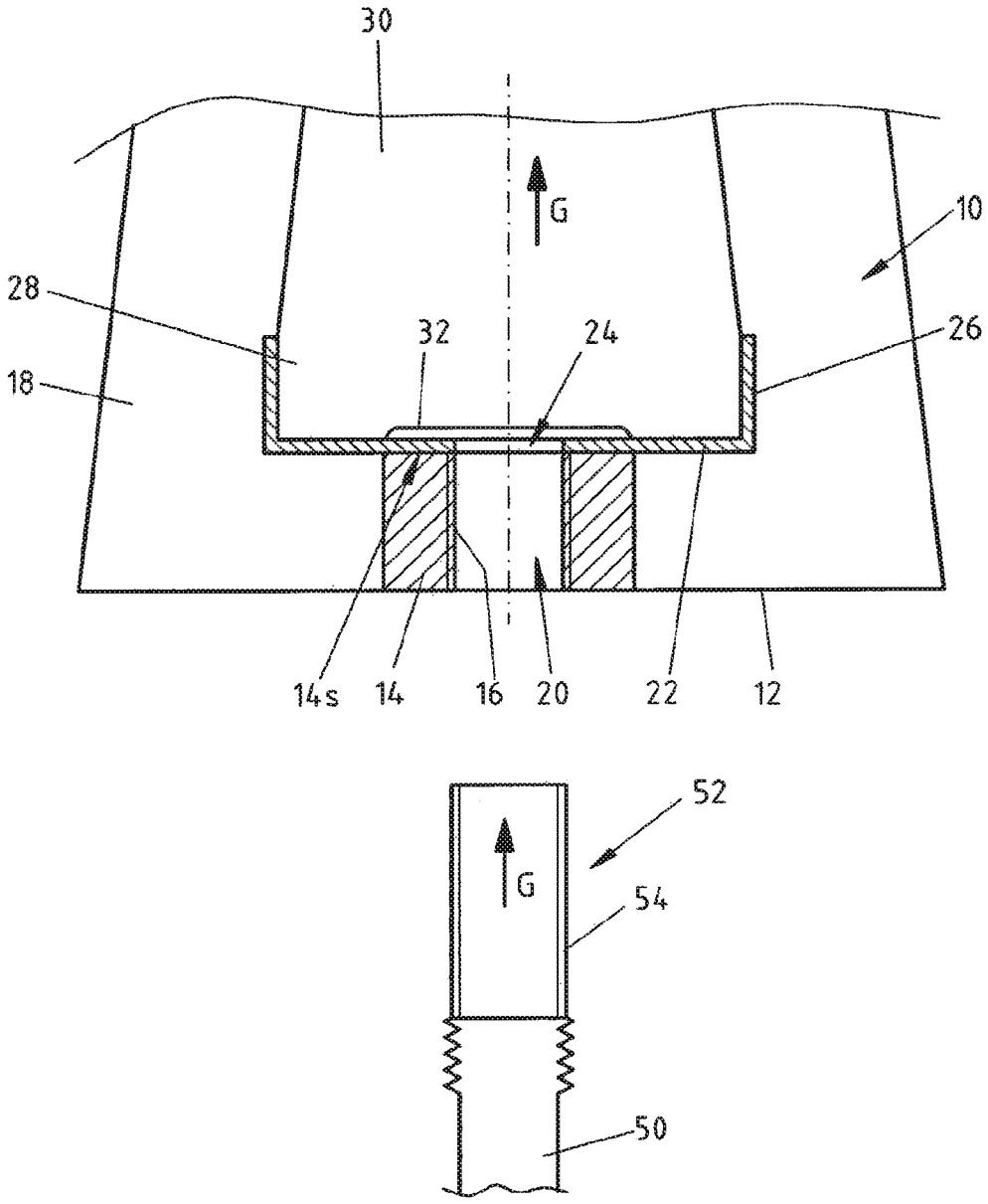

(51) Int. Cl.
*B22D 1/00* (2006.01)
*C21C 5/48* (2006.01)
*C21C 5/34* (2006.01)

(58) Field of Classification Search
USPC ..... 266/220
See application file for complete search history.

(56) References Cited

FOREIGN PATENT DOCUMENTS

| | | | |
|---|---|---|---|
| DE | 9206486 | U1 | 7/1992 |
| DE | 4312981 | A1 | 10/1994 |
| DE | 19948848 | C1 | 7/2000 |
| DE | 10305232 | B3 | 8/2004 |
| EP | 0609562 | A1 | 8/1994 |
| EP | 0924009 | A1 | 6/1999 |

* cited by examiner

GAS PURGING ELEMENT AND ASSOCIATED GAS CONNECTION ELEMENT

The invention relates to a gas purging element for metallurgical applications, for example, for installation in a metallurgical vessel, as well as a corresponding gas connection element.

A gas purging element, alternatively called gas purging brick, serves to blow gases or gas-/solid/mixtures respectively, in a melt, in particular a metallurgical melt to be treated. In case of a gas purging brick of directed porosity the gaseous treating fluid is guided along corresponding channels/slits; in case of gas purging bricks with so-called random porosity the treating fluid is guided along a corresponding irregular pore volume (similar to a sponge).

The installation of a gas purging element in a bottom or a wall of a metallurgical vessel can be realized in different ways. Typically the gas purging brick is arranged within a corresponding well-block. Outside, at the end, where the gas is fed in (so-called cold end) the purging element is secured to the metallurgical vessel via a corresponding mechanism. For dismantling or replacing the purging element the mechanism is opened. A corresponding example is given by EP 363651 B1. This purging element further displays a gas distribution chamber at its cold end.

Gas purging bricks of the type mentioned and corresponding assembling jigs have been proved since decades. Nevertheless there is a problem insofar, as efforts for dismantling/fitting during replacement of a gas purging element are high and long lasting.

For example from EP 0148337 A1 it is known to surround the gas purging element with a steel sheet to avoid diffusion of the gas into the adjacent refractory material. In most cases the steel sheet runs circumferentially and in the bottom area of the purging element. The bottom sheet comprises an opening, which is followed by a gas connection pipe, which freely protrudes the bottom sheet. Gas is fed via said gas connection pipe into the gas permeable ceramic part of the purging element. The gas connection pipe is troublesome during transport and fitting of the purging device.

It is an object of the invention to provide a structurally simple alternative to simplify the mounting (fitting) or dismantling of a gas purging brick and to minimize a gas loss.

The invention starts from the following considerations:

A steel-sheeted gas purging brick (EP 0148337 A1) has several advantages. It has a high dimension accuracy and avoids gas loss. Nevertheless the protruding gas connection pipe is bothering during transport and fitting.

A gas purging brick without a steel sheath is easy to transport. But it is rather difficult to achieve a simple and tight connection to a gas source. The size accuracy of the purging element and the corresponding fitting device (EP 0363651 B1) must be very high to avoid defects and leakages. At a hot metallurgical vessel, this is only hard to realize.

Therefore the invention moves to a different direction:

The decisive feature is to construct a gas purging element in such a way that the corresponding gas pipe may be fitted inside (in the interior) of the purging element. This allows the following effects:

- The cold end of the purging element is defined by the lower front surface or a corresponding steel casing respectively; protruding parts as welded gas connection pipes, protruding outwardly, are avoided.

- The gas connection is achieved inside the purging element, i. e. exactly where the gas is needed.
- For connecting a corresponding gas pipe a depression is arranged at the cold end of the gas purging element. Thus, the ceramic part of the purging element comprises a gas connection. Insofar ceramic material is saved.
- The depression does not only serve to connect/fit a gas pipe but as well to guide and fix the gas pipe.
- This makes it possible to provide a guidance between gas purging element and gas pipe over a certain axial length (seen from the cold end of the gas purging element to the opposite hot end). At the same time this enables to connect both parts without complex mechanisms. For example a gas connection element may be screwed into the depression. Further fastening means for the gas pipe are possible but not necessary. The complex tilting mechanisms are avoided.

In its most general embodiment the invention relates to a gas purging element for metallurgical applications, comprising the following features in its mounted (fitted, used) state:

- ceramic refractory body with a lower end and an upper end,
- the upper end features an upper front surface,
- the lower end features a lower front surface.
- a depression extends from the lower front surface into the lower end of the ceramic refractory body,
- the depression comprises a first part of a detachable, form-fit connection to a gas connection element,
- a fluidic connection for a treating gas through at least one gas permeable section of the ceramic refractory body is provided between the depression and the upper front surface.

The important feature is the depression (recess, cavity) which provides a first part (functional part) of a detachable, form-fit connection to a gas connection element.

This depression may be realized in different ways, for example as part of one of the following connection structures: screw connection, bayonet connection, push-push-quick connection, push-twist-quick connection. Bracket connections or snap-on connections are included.

In case of a construction, as a quick coupling or bayonet connection a gas pipe may be simply pushed into the depression and/or turned/twisted until the gas pipe is in the desired form fit position with the corresponding connection part in the depression of a gas purging element. This takes just a few seconds and may be realized as well at a hot metallurgical vessel without problems, if wanted, by using a manipulator (robot).

Any aligning, adjusting, turning, additional fixations by a mechanism at the wall of the metallurgical vessel can be avoided.

This is also true in case the depression and gas connection pipe provide threads for a screw connection at their corresponding parts/sections.

The important advantage of all these connection techniques is that these form-fit connections can be realized without problem as gas tight connections while being detachable. To replace a gas purging element the gas pipe may be dismantled in a reverse manner (compared with a fitting) and may be reused at a later time.

The connections disclosed enable a force-fit connection between gas purging element and gas connecting element without any additional installations.

According to one embodiment the depression, starting from the lower front surface, displays at least one of the following geometries: cylinder, cone, truncated cone, prism.

The horizontal cross-section of the depression/cavity (in other words: perpendicular to the main flow direction of the gas through the purging element) may correspondingly be circular, rectangular, polygon.

A first section (starting from the front surface of the gas purging element) may also be cylindric and an adjacent section designed as a truncated cone. The cylindrical part enables a favourable guidance and fixation, the part designed as a truncated cone may be used for an additional sealing (gasket).

A gas distribution chamber may be placed within the ceramic refractory body in said depression or fluidicly subsequent to said depression, seen towards the upper front surface. The gas, supplied via the gas pipe, may first flow into the gas distribution chamber and from there through the gas permeable ceramic sections.

Alternatively or cumulatively a break-through protection device against infiltrating metal melt may be arranged in the depression of the ceramic body (or fluidly after or before said depression).

The break-through protection device can be designed as a replaceable unit, which will be connected with a corresponding part of the gas feeding pipe or the depression. Such break-through protection devices are per se known, but within other constructions of gas purging elements. For example one of the following constructions may be integrated:

- The gas feeding pipe receives a spiral/helical shape to enlarge the axial length,
- a cooled-section is arranged around the gas feeding pipe so that any infiltrating metal melt may solidify faster.

That part of the depression, that forms the first part of the connection to the gas connection element, may be formed in-situ within the ceramic material (insofar it is made of ceramic) and/or it may be a discrete part. In case of a screw connection the depression may provide a threaded section, formed within the ceramic; a socket/jacket or nut with the corresponding inner thread may alternatively be fitted within the depression and/or glued therein.

Further embodiments provide the following features:

- At least one gas permeable part of the refractory ceramic body starts from an inner end of the depression.
- The gas permeable part of the refractory ceramic body, which is adjacent to the inner end of the depression, may be provided at least partially with a metal cover. In other words: A gas permeable ceramic section, formed within the ceramic body, comprises at least sectionally a metal bottom and/or a metal surrounding, of course with at least one opening to feed a treating gas from the gas connecting pipe and/or the gas distribution chamber. The gas outlet end of the gas permeable section is open as well. This design avoids any potential gas loss and makes manufacturing easier.
- In a circumferential direction and/or at the bottom side, radially with respect to the depression, the purging element may be made of a gas tight ceramic. In other words, the gas permeable section is surrounded, at least sectionally, by a gas impermeable section.
- The gas purging element may have several gas permeable sections of different construction next to each other (radially with respect to the gas flow) and/or subsequently (in the direction of the gas flow).

The gas purging element may be fitted with an outer metal envelope (metal casing) but not necessarily. The metallic envelope may surround the purging element completely (with the exception of the upper front surface and the area of the depression at its cold end), just the lower end of the refractory ceramic body or just the lower front surface of the refractory ceramic body (as well with the exception of the area of the depression).

The gas purging element may be designed in such a way that no parts/elements protrude the lower front surface. In other words: the gas purging element is "flat" (planar) at its cold end. The lower front surface provides the termination of the cold end of the purging element. All types of latch parts, fixing elements, bearings or the same, protruding the bottom outwardly, may be avoided according to the invention.

Besides the ceramic gas purging element the invention also relates to a corresponding gas connection element, comprising the following features:

A first end and a second end, wherein

- the second end is designed, correspondingly to the first part of the depression of the gas purging element, as a complementary second part of said detachable, form-fit connection with the gas purging element.

For example the second end may thus be designed as a mating thread for a threaded section of the depression of the gas purging element or a section of a bayonet latch.

The first end of the gas connection element can be designed to adapt to a corresponding (further) gas feeding pipe or may be directly fitted to a gas source.

The gas connection element can be made of metal and/or any other material which is stable at temperatures prevailing during use of a gas purging element at a metallurgical vessel at its "cold end".

Generally spoken the depression within the gas purging element and the corresponding end of a gas connecting element form a male part and a female part respectively of a corresponding form-fit connection.

The depression can also be made as an adapter to fix the gas connecting element in the gas purging element.

The connection makes it possible to connect adjacent sections (of the gas feeding system and the gas purging element) in the flow direction of the gas in a simple manner. At the same time the connection allows a predominantly gas tight connection. This can—for example—be realized in that corresponding sections of the connection are designed in a corresponding conical/truncated cone design and linked to each other.

Optionally, an additional safety element may be used to mechanically secure/fix adjacent sections in the connection position.

Further features of the invention are described in the features of the subclaims as well as in the other application documents.

The invention will now be explained in more detail with the help of various embodiments. In a highly schematic way the following is shown:

FIG. 1: A vertical cross section of a gas purging element and a corresponding gas connection element of the invention.

Figure 2:
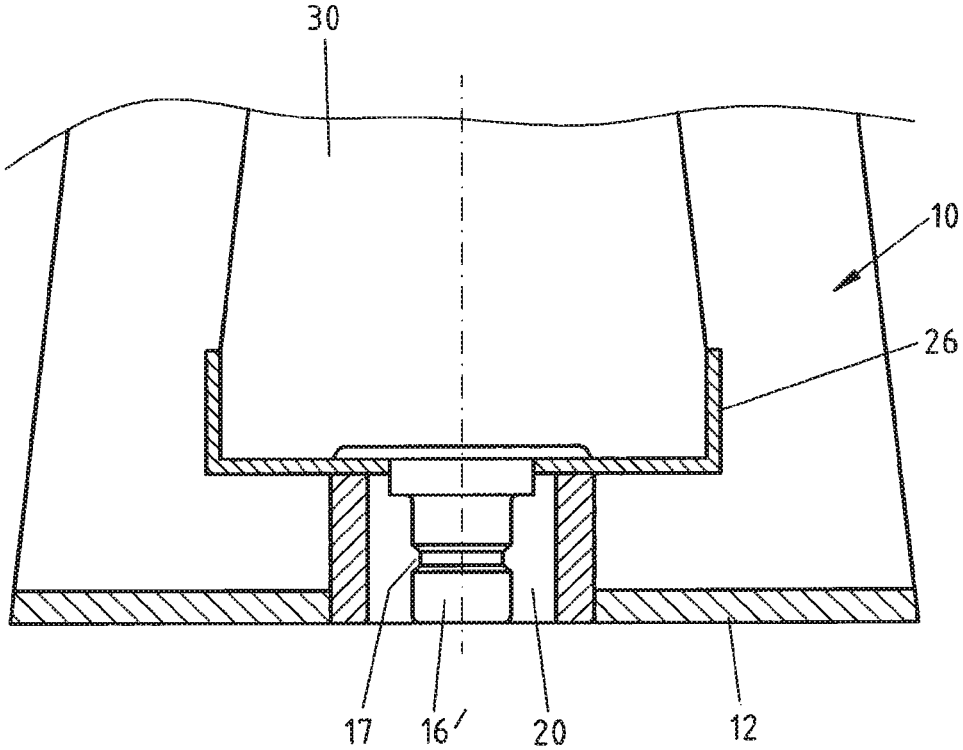
Figure 2:
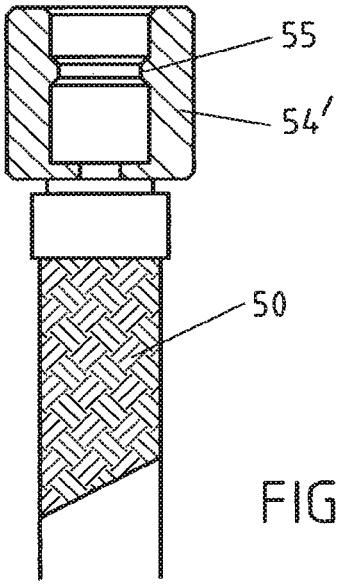

FIG. 2: A presentation according to FIG. 1 for a second embodiment.

Figure 3:
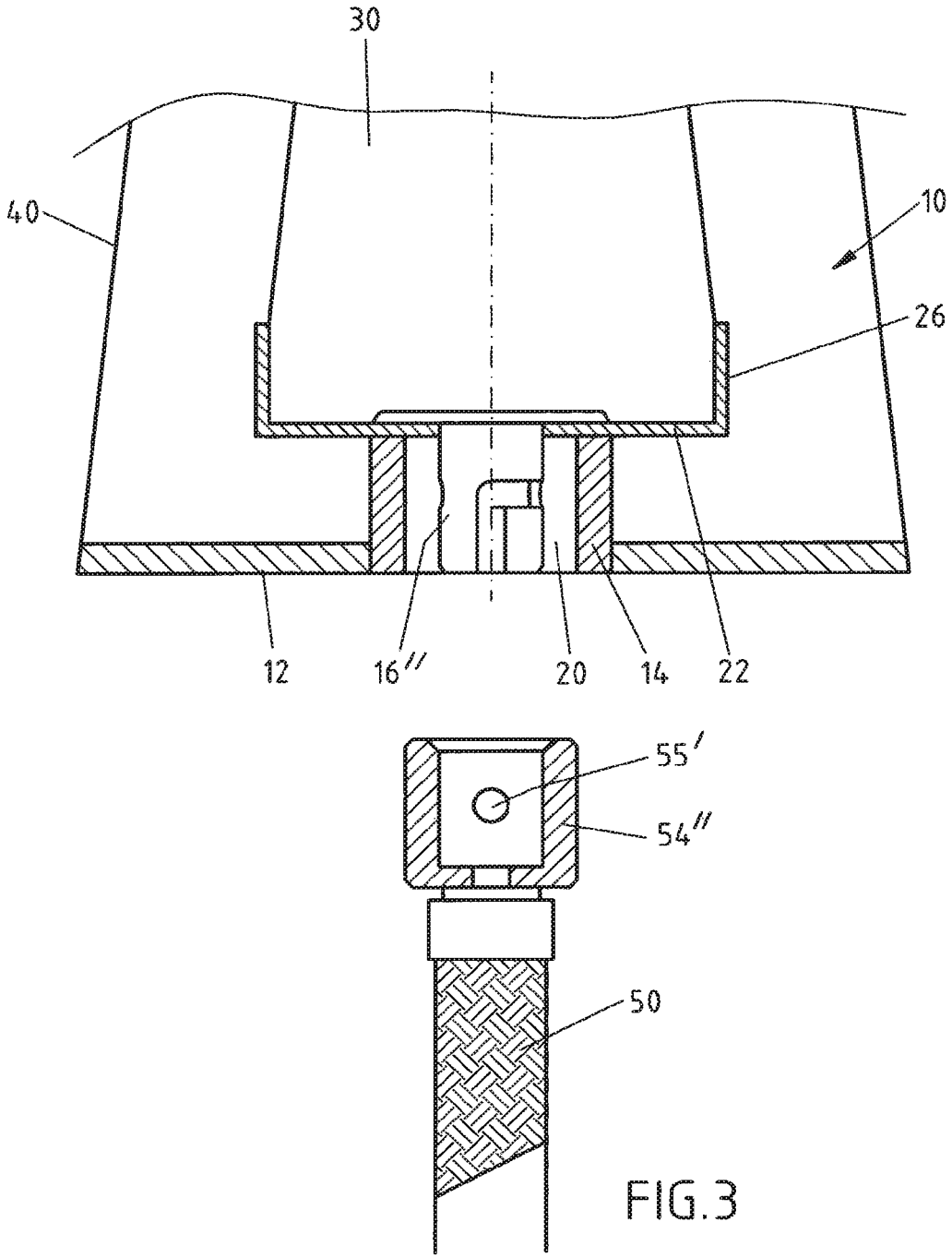

FIG. 3: A presentation according to FIG. 1 for a third embodiment.

In the Figures identical parts or parts having the same effect are represented by the same numerals.

Numeral 10 relates to a gas purging element in the shape of a truncated cone, the lower end of which is displayed. A metallic cylinder 14 with an inner thread 16 extends from a flat bottom 12 into a gas tight ceramic outer part 18 of the gas purging element 10.

The inner thread (female thread) thus limits a cylindrical hollow space (depression 20), into which a corresponding gas connection element 50 (a gas feeding pipe) may be inserted. For this purpose a gas feeding pipe 50 provides a corresponding outer thread (male thread) 54 at is upper, second end 52, displayed in FIG. 1.

A ring-shaped metal plate is fixed (welded) to the upper, ring-shaped front surface (14*s*) of said cylinder 14, which metal plate provides a middle opening 24, corresponding to said hollow space 20 and a cylindrical wall 26 extends from the periphery of said metal plate 22 towards an upper, not displayed end of the gas purging element, resulting in a pot-like geometry for said parts 22, 26 with a hole in the bottom.

This "pot" serves to achieve a lower end 28 of a gas permeable ceramic part 30. This part 30 has a central depression 32 at its bottom such that it rests onto said steel plate 22 only peripherally, while circumferentially its lower part abuts said wall 26 and its part following upwardly abuts the gas impermeable section 18 of said gas purging element 10.

A gas distribution chamber between the gas permeable part 30 and the steel sheet 22 is thus provided by said recess (depression) 32.

By screwing the thread 54 of the gas connection element onto said thread 16 of the gas purging element 10 and connecting the gas connection element to a gas source, the gas connection is performed.

Thereafter, the gas purging process may immediately start. Gas then flows through the gas connection element 50 (arrow G) and insofar through hollow space (depression) 20 into the gas distribution chamber (realized by said recess 32) and further through the open porosity of the gas purging part 30 (arrow G) until the gas leaves the gas purging element (10) via its (not displayed) upper front surface and enters a corresponding metal melt.

The displayed gas purging element has a flat bottom 12. Towards the outside (in the displayed functional (use) position: downwardly) no parts protrude during transport and fitting of the gas purging element 10. This in an important feature of the gas purging element and makes fitting/connection to a gas feeding pipe (a gas connection element) after fitting of the gas purging element in a bottom or a wall of a metallurgical melting vessel easier.

The embodiments according to FIGS. 2 and 3 differ by the connection technique of gas purging element 10 and gas connection element 50.

In the variant according to FIG. 2 this connection is realized as a so-called quick coupling. For this purpose a "male part" 16' is arranged in said depression (hollow space 20). The part 16' is fixed to the bottom 22 and protrudes downwardly into the hollow space 20, namely down to the bottom 12 of the gas purging element 10. Part 16' has about a cylinder shape with a recessed ring-shaped part 17.

Correspondingly and replacing the outer thread 54 a "female part" 54' is realized in this quick coupling, wherein this part 54' has a pot-like shape and a ring-shaped throat (neck), which is designed correspondingly to the recessed section 17 of part 16' such that when part 54' is pushed onto part 16' the ring-shaped throat 55 lands into said recessed section 17, wherein part 54' is provided with a certain elasticity.

As a quick coupling as such, for other purposes, relates to prior art, it is not further explained and displayed.

It is self-evident, that the dimensions of the hollow space 20 must enable to take part 54 and preferably such that part 54' with its cylindrical outer surface may be arranged flush at the cylindrical outer wall of hollow space 20 in a use position.

It is further to be explained that the bottom of the gas purging element is a metal bottom in FIG. 2.

The embodiment of FIG. 3 is similar to that according to FIG. 2. The gas purging element 10 and the gas connection element 50 are linked to each other via a kind of a bayonet lock instead of a quick coupling.

For this purpose part 16" has an L-shaped depression on its circumferential wall, serving to take pin 55', which protrudes perpendicular with respect to the inner wall of part 54".

To connect the gas purging element 10 and gas connection element 50 the second end of the gas connection element 50 is pushed onto part 16" axially, whereby pin 55' runs along the axially extending part of the L-shaped depression at the beginning. Thereafter, the gas connection element 50 is twisted relative to part 16" such that pin 55' enters into the horizontal part of the L-shaped notch and will then be secured against axial detachment.

A gas purging element 10 of FIG. 3 further provides a circumferential metal sheet 40, which is connected to the bottom sheet 10 in a gas tight manner, which is interrupted just in the area of the cylinder 14.

The invention claimed is:

1. Gas purging element (10) for metallurgical applications, comprising the following features in its mounted state:

a) a ceramic refractory body (10, 30) with a lower end and an upper end, b) the upper end features an upper front surface, c) the lower end features a lower front surface (12), d) a depression (20) extends from the lower front surface (12) into the lower end of the ceramic refractory body (10), e) the depression (20) contains a first part (16, 16', 16") of a detachable, gas tight and form-fit connection to a gas connection element (50), f) a fluidic connection for a treating gas through at least one gas permeable section (30) of the ceramic refractory body (10) is provided between the depression (20) and the upper front surface, wherein g) said detachable, gas tight and form-fit connection is from the group comprising: a screw connection, a bayonet connection, a push-push quick connection and a push-twist quick connection.

2. Gas purging element according to claim 1, wherein the depression (20), starting from the lower front surface (12), displays one of the following geometries: cylinder, cone, truncated cone, prism.

3. Gas purging element according to claim 1 with a gas distribution chamber (32) being arranged in the depression (20) or fluidly subsequent to the depression (20), towards the upper front surface.

4. Gas purging element according to claim 1 with a break through protection device against infiltrating metal melt being arranged in the depression (20) or fluidly subsequent to the depression (20), towards the upper front surface.

5. Gas purging element according to claim 1, wherein the part (14, 16, 16', 16") of the depression (20) is in-situ formed within the refractory ceramic body (10,30).

6. Gas purging element according to claim 1, wherein the part (14, 16, 16', 16") of the depression (20) is a discrete part.

7. Gas purging element according to claim 1, wherein at least one gas permeable section (30) of the ceramic refractory body (10) extends from an inner end of the depression (20).

8. Gas purging element according to claim 7, wherein that gas permeable section (30) of the refractory ceramic body (10, 30), which is adjacent to the inner end of the depression (20), partially features a metal cover (22).

9. Gas purging element according to claim 1 with an outer metal envelope (40), which covers the lower end of the ceramic refractory body (10, 30) circumferentially, the lower front surface (12) of the ceramic refractory body (10, 30), or both.

10. Gas purging element according to claim 1 without any elements protruding the lower front surface (12).

11. Gas connection element (50) for a gas purging element according to claim 1, with a first end and a second end (52), wherein the second end (52) is designed, correspondingly to the first part (14, 16, 16', 16") of the depression (20) of the gas purging element (10), as a complementary second part (52) of said detachable, form-fit connection with the gas purging element (10).

* * * * *